United States Patent [19]

Rose et al.

[11] 4,293,338

[45] Oct. 6, 1981

[54] DIFFUSION COATING COMPOSITION OF IMPROVED FLOWABILITY

[75] Inventors: Bernard R. Rose, Ipswich, Mass.; John K. Willis, Salem, N.H.

[73] Assignee: Walbar Metals, Inc., Peabody, Mass.

[21] Appl. No.: 60,891

[22] Filed: Jul. 26, 1979

[51] Int. Cl.[3] ..... B22F 9/00

[52] U.S. Cl. ..... 75/253; 75/138; 75/255; 106/1.12; 427/253

[58] Field of Search ..... 75/0.5 A, 0.5 AA, 0.5 B, 75/0.5 BA, 138, 170, 171, 251, 252, 253, 255; 148/31.5; 106/1.12, 1.22; 427/252, 253

[56] References Cited

U.S. PATENT DOCUMENTS 2,604,855 7/1952 Reynolds et al. ..... 75/138

4,132,816 1/1979 Benden et al. ..... 427/253

OTHER PUBLICATIONS

Hansen, M.; *Constitution of Binary Alloys 2ed.*, McGraw-Hill Book Co., New York, N.Y., pp. 79–80, (1958).

*Primary Examiner*—Michael L. Lewis

*Attorney, Agent, or Firm*—Pearson & Pearson

[57] ABSTRACT

Improved powder-type diffusion-coating compositions for use in codeposition processes involving the formation of diffusion coating of chromium and aluminum on high nickel and high cobalt alloys known as superalloys. The compositions are characterized by easy flowability and, particularly, by the use of the intermetallic compound $Co_2Al_9$.

9 Claims, No Drawings

DIFFUSION COATING COMPOSITION OF IMPROVED FLOWABILITY

BACKGROUND OF THE INVENTION

The invention relates to the diffusion coating of superalloys, such as high-nickel and high-cobalt alloys, wherein a part to be treated is placed in a coating, powder pack.

It is already known that diffusion coating of metallic objects, for example nickel- and cobalt-based alloys, may be carried out by embedding the article to be coated in a powdered coating pack including:

(1) an inert filler, (2) a vaporizable carrier ingredient, and (3) powdered sources of metal materials to be diffused into the superalloy object.

The vaporizable carrier ingredient, usually a halide composition, acts as a flux in facilitating the initial reaction between aluminum and the alloy being treated, and also acts to accelerate the diffusion process by forming intermediate or transient compounds during the process. In general, the vaporizable carrier material has been a halide, for example a fluoride or chloride salt, such as ammonium chloride. This relatively diffusable material provides means for carrying the treating metal into the superalloy surfaces to be treated.

The metal powder, usually aluminum or choronium, is the active metal-treating agent on which the carrier material acts to facilitate diffusion of the metal into the article to be treated.

The inert filler acts primarily as a means to moderate the concentration and rate at which the carrier material and diffusing metal approach the metal article to be treated. It is also a manipulative expedient which provides the function of reducing the cost of material expended in carrying out the process. Cost of the material in a powder pack usually requires that the pack is to be used for a number of treating cycles. In such cases the pack is usually refurbished with the more-readily depleted components before proceeding from one cycle to another.

Processes of this general type have been disclosed by Wachtell and Seelig in U.S. Pat. No. 3,257,230 and by Puyear and Schley in U.S. Pat. No. 3,079,276. The object of such processes is to provide a protective outer sheathing on engineering parts subjected to high temperatures and corrosive atmospheres; for example, the turbine blades in jet aircraft engines are subjected to such temperature and environment.

Some additional prior art includes packings which utilize $Co_2Al_5$ (e.g. PWA 273, a material sold by Pratt & Whitney Division of United Technologies, Inc. and packings such as those described in a number of patents including U.S. Pat. Nos. 3,716,398; 3,594,219; 3,577,268; 3,810,782; 4,024,294; 4,041,196; 3,979,274; and many more such patents primarily classified in U.S. Classification 117 (old) and Class 427.

There are many aspects of these diffusion processes for pack cementation coatings that it would be desirable to enhance. Some such aspects relate to the mechanical properties of the powder composition: for example, it would be very desirable for the used coating powder to be readily released from some of the very small apertures and channels that are encountered in the alloy parts being treated. Moreover, it is always desirable to improve the "hot corrosion" resistance of internal as well as external surfaces of the parts by subjecting them to treatments of the type being described.

As will be described below, the invention described herein is based on the surprising discovery of the value of certain cementatious coating powders.

SUMMARY OF THE INVENTION

It is an object of the present invention to provide improved powder compositions for use in cementatious pack coating of super alloys.

A more particular object of the invention is to provide such compositions which form means to improve the properties of parts treated with the new composition.

Another object of the invention is to provide compositions of superior flowability after they have been subjected to processing temperatures.

Other objects of the invention are to obtain an improved diffusion coating process, one which may be used to achieve more rapid processing and one which may be used to achieve superior properties of the processed goods.

Other objects of the invention will be obvious to those skilled in the art on their reading of this disclosure.

The above objects have been substantially unexpectedly and surprisingly achieved by the development and use of a powdered cementation pack coating composition comprising the intermetallic powder $Co_2Al_9$, particularly the powder which passes 325 mesh.

The amount of $Co_2Al_9$ that is utilized in the composition of the invention will differ somewhat depending on the particular use of the coating. For example, different quantities will be used in packings that are intended for internal surfaces (i.e. surfaces of inerstices or orifices) and in external surfaces (i.e. the larger exterior surface of a part). One advantage of the compositions of the invention is the fact that they can readily be used in a single coating operation both for internal and external use. Another advantage is that the processes may be carried out at lower time-temperature profiles than processes carried out with such intermetallics as $Co_2Al_5$, $Cr_8Al_5$ or CoAl.

The superalloys which are believed to be most advantageously treated by the process of the invention are the nickel-based superalloys especially e.g. those comprising about 16% chromium or less. Particular advantage is achieved with those alloys such as to the art as IN100 and IN713 and IN792 which contain about 13% chromium or less.

It will be understood by those skilled in the pertinent art that the compositions of powder-pack compositions are varied depending upon the particular application involved. For example, somewhat higher chromium content in the metal being treated usually dictates a somewhat higher chromium content in the powder to facilitate diffusion of chromium into the surface of the metal. Likewise, the presence of cobalt in the metal slows diffusion of aluminum and this effect can be counteracted by changing the powder composition. Also, the powder weight to surface area ratio is so different for internal surfaces of a part being treated from powder weight to surface area ratio achieved at exterior surfaces, that this factor dictates substantial changes in coating powder composition. (Thus, for example, the internal surfaces of a part being prepared for treatment could suitably contain a coating powder composed of 8 to 10% $Co_2Al_9$ and 3 to 4% chrome, whereas the external surfaces being prepared for treatment might be packed with a mixture of 3-4% $Co_2Al_9$ and 2-4% chrome.)

The process of the invention can typically be accomplished in less than half the time required for similar processing with conventionally used powder packings. For example, a cycle time of about 1½ hours can be used in some applications as opposed to 3 to 4 hour cycles achieved with powder pack compositions which are presently available. Thus a 0.002-inch-thick diffusion coating can be imparted to, say IN100 or IN713 alloy in 1½ hours at a heat treating temperature of 1925° F., whereas the same result would take at least about twice as long using the powder packs of the prior art.

Oxidation resistance of coatings prepared according to the invention may be improved from 100% to 200% over coatings of the prior art, when utilizing a 3% $Co_2Al_9$, 2% chromium powder pack ("3-2 mix"). This has been shown by a high velocity oxidation test which is intended to be a partial simulation of operating conditions in the hot zone of a jet engine. Excellent results are also achieved with a 3-4 mix. Thus products comprising the diffusion coating of the invention exhibit excellent oxidation/ablation resistance at temperatures of 2000°-2100° F.

A simulated Inconel 713 turbine blade coated with a co-deposited diffusion coating derived from a 3% $Co_2Al_9$ 4% Cr pack, shows hot corrosion resistance approximately 50% greater than a "state of the art" aluminide coating. This has been validated by a 1730° F.-1750° F. hot corrosion test which, in part, simulates jet engine operating conditions.

One valuable and novel characteristic of the compositions of the invention is that they are resistant to being immobilized by a heat treatment at about 2000° F. and, therefore, remain readily flowable after 2 hours of such a treatment.

ILLUSTRATIVE EXAMPLES OF THE INVENTION

In this application there is shown and described preferred embodiments of the invention and suggested various alternative and modifications thereof, but it is to be understood that these are not intended to be exhaustive and that other changes and modifications can be made within the scope of the invention. These suggestions herein are selected and included for purposes of illustration in order that others skilled in the art will more fully understand the invention and the principles thereof and will be able to modify it, each as may be best suited in the condition of a particular case.

EXAMPLE I

A turbine blade, whose service condition has been categorized by a jet engine operator as high oxidation and cast from a high-nickel alloy sold under the trade designation "IN-100" by the International Nickel Company, was degreased by exposure to trichloroethane solvent vapors. (After this degreasing all handling of the turbine blade was carried out with cotton gloves). Thereupon the area of the turbine blade to be subjected to the diffusion coating process was abrasively cleaned with $Al_2O_3$ grit which had passed a 120 mesh sieve but has been retained on a 220 mesh sieve. After this blasting process, the turbine blade was once more degreased.

After these preparatory steps, the turbine blade was packed into a coating container, which has been prepared according to procedures known in the art and packed in a coating powder formulation comprising:

| Constituents | % by weight |
|---|---|
| Calcined aluminum oxide (pass 100 mesh) | 94.5% |
| $Co_2Al_9$ (pass 325 mesh) | 3.0% |
| Chromium powder (pass 325 mesh) | 2.0% |
| Sodium Fluoride | 0.5% |

This is designated as the RB-505A blend for applications requiring high oxidation resistance.

Workpieces should be placed in the coating container in such a way that there is about a 0.5 inch gap between adjacent pieces.

The powder box was loaded into a retort which is provided with means to circulate gas therethrough, means to insert thermocouples thereinto for the remote reading of temperature therein and a sand seal to prevent the ingress of air thereto. After the retort was closed, it was purged with Argon gas at a rate of about 7 volume changes per hour and then placed into a gas-fired pit furnace. Argon gas was constantly fed into the retort at a rate of about 5 volume changes per hour as the temperature inside the retort was rapidly raised to 1925° F. and held there for an hour. The retort was then withdrawn from the furnace, and the parts were unpacked from the powder pack.

The coated nickel-base turbine blades were carefully cleaned with a stiff-bristled brush and compressed air. Thereupon, the part was inspected and washed for three minutes in warm water and dried.

The parts were then loaded in a clean retort not previously used for diffusion coating and heat treated in a hydrogen atmosphere for one hour at 1950° F. Purging technique and gas flow rates were similar to that described for the coating process, above.

After metallographic examination of a test piece so treated, an excellent codeposited diffusion coating of about 0.0025 inches on depth was achieved during this process.

EXAMPLE 2

Example 1 was repeated but now a turbine nozzle guide vane of Inconel 738 alloy whose service condition has been categorized by a jet-engine operator as high hot corrosion. The following powder formulation was used:

| Constituents | Parts by Weight |
|---|---|
| $Co_2Al_9$ #325 mesh | 3.0 |
| Chromium, #325 mesh | 4.0 |
| NaF | 0.5 |
| Calcined, aluminum, oxide, #100 mesh | 92.5 |

This is designated as the RB505-B blend for applications requiring high hot corrosion resistance.

The pack temperature was 1950° F. and the treatment time was two hours in an Argon atmosphere. The post-treatment was at 1975° F. for one hour in a hydrogen atmosphere and resulted in an excellent codeposited diffusion coating of aluminum and chrome of 0.0025 inches in depth.

EXAMPLE 3

This example relates to a hollow-turbine blade with internal cooling passages.

Example 1 was repeated excepting that the parts being treated had small apertures or conduits about 0.020 inches in diameter. The parts were supported on a vibrating table so that orifices, conduits and interstices, as small as 0.010 inch, were upwardly. Lower outlets of such orifices were taped to prevent egress of powder. Then, while the table vibrated, the orifices, conduits and interstices were filled with a powder of the following formulation:

| Constituents | Parts by Weight |
|---|---|
| $Co_2Al_9$ #325 mesh | 10.0 |
| Chromium, #325 mesh | 4.0 |
| $NH_4F$ | 0.75 |
| Calcined, aluminum, oxide, #100 mesh | 85.25 |

This is designated as the RB505-C blend for applications requiring high hot corrosion resistance of internal surfaces.

After the interstices were filled and the upper outlets taped shut, vibrating was continued for about two minutes. Thereupon, the turbine blades were carefully packed in powder of the following formula, the RB505-B blend.

| Constituents | Parts by Weight |
|---|---|
| $Co_2Al_9$ #325 mesh | 3.0 |
| Chromium #325 mesh | 4.0 |
| NaF | 0.5 |
| Calcined Aluminum Oxide, #100 mesh | 92.5 |

Thereupon, the heat treating step was carried out at about 1925° F. for 2 hours in an argon atmosphere and an excellent codeposited diffusion coating was obtained simultaneously on the interior and exterior surfaces of the articles being treated.

It is also to be understood that the following claims are intended to cover all of the generic and specific features of the invention herein described and all statements of the scope of the invention which might be said to fall therebetween.

What is claimed is:

1. A particulate composition of matter forming means from which to expel aluminum and chromium at elevated temperatures, said composition comprising an inert filler, effective quantities of a halide carrier, chromium metal powder, and an aluminum-contributing powder of the compound $Co_2Al_9$.

2. A composition as defined in claim 1 wherein said halide carrier is NaF.

3. A composition as defined in claim 1 or 2 wherein the composition comprises from 1 to 15 percent of $Co_2Al_9$.

4. A composition as defined in claim 1 or 2 wherein the composition comprises from 2 percent to 6 percent of chromium.

5. A compositon as defined in claims 1 or 2 wherein said powder is resistant to being immobilized by a heat treatment in argon at about 2000° F. and remains readily flowable after 2 hours of such a treatment.

6. A composition as defined in claim 3 wherein the composition comprises from 2 percent to 6 percent of chromium.

7. A composition as defined in claim 3 wherein said powder is resistant to being immobilized by a heat treatment at about 2000° F. and remains readily flowable after 2 hours of such a treatment in argon.

8. A composition as defined in claim 4 wherein said powder is resistant to being immobilized by a heat treatment at about 2000° F. and remains readily flowable after 2 hours of such a treatment in argon.

9. A composition as defined in claim 1 wherein said halide carrier is $NH_4F$.

* * * * *